US007914400B2

(12) United States Patent
Flading et al.

(10) Patent No.: US 7,914,400 B2
(45) Date of Patent: Mar. 29, 2011

(54) BASEBALL PRACTICE SYSTEMS

(76) Inventors: John Flading, Marietta, GA (US); Larry Duane Cripe, Seattle, WA (US)

( * ) Notice: Subject to any disclaimer, the term of this patent is extended or adjusted under 35 U.S.C. 154(b) by 111 days.

(21) Appl. No.: 12/339,939

(22) Filed: Dec. 19, 2008
(Under 37 CFR 1.47)

(65) Prior Publication Data

US 2009/0163301 A1 Jun. 25, 2009

Related U.S. Application Data

(60) Provisional application No. 61/016,318, filed on Dec. 21, 2007, provisional application No. 61/138,219, filed on Dec. 17, 2008.

(51) Int. Cl.
*A63B 69/00* (2006.01)

(52) U.S. Cl. ..... 473/426; 473/422; 473/452; 473/451

(58) Field of Classification Search ..... 473/422, 473/417, 426, 452, 451, 427
See application file for complete search history.

(56) References Cited

U.S. PATENT DOCUMENTS

| | | | | | |
|---|---|---|---|---|---|
| 849,941 | A | | 4/1907 | Titus | |
| 1,554,409 | A | | 9/1925 | Coffee | |
| 1,591,753 | A | | 7/1926 | Flaugh | |
| 2,292,109 | A | | 8/1942 | Engel | |
| 2,839,300 | A | | 6/1958 | Blaha et al. | |
| 3,408,071 | A | | 10/1968 | Lundy | |
| 3,717,343 | A | | 2/1973 | Hartford | |
| 4,161,313 | A | | 7/1979 | Dickey | |
| 4,445,685 | A | * | 5/1984 | Cardieri | 473/417 |
| 4,735,413 | A | * | 4/1988 | Yamanouchi et al. | 473/426 |
| 4,867,448 | A | | 9/1989 | Judd | |
| 4,962,924 | A | * | 10/1990 | James | 473/417 |
| 5,040,791 | A | | 8/1991 | Ratajac et al. | |
| 5,056,781 | A | | 10/1991 | Preston et al. | |
| 5,072,937 | A | * | 12/1991 | Zarate | 473/426 |
| 5,386,986 | A | | 2/1995 | Gamboa | |
| 5,407,211 | A | | 4/1995 | Bottiglieri | |
| 5,419,550 | A | | 5/1995 | Blom | |
| 5,458,326 | A | | 10/1995 | Marcyes | |
| 5,460,364 | A | | 10/1995 | Ring | |
| 5,536,004 | A | * | 7/1996 | Wiseman et al. | 473/417 |
| 5,588,646 | A | * | 12/1996 | Dickson | 473/426 |
| 5,776,017 | A | * | 7/1998 | Brawn | 473/426 |
| 5,795,250 | A | | 8/1998 | Cripe | |
| 6,099,418 | A | * | 8/2000 | Owen | 473/417 |
| 6,168,540 | B1 | * | 1/2001 | McKenna | 473/426 |
| 6,306,050 | B1 | * | 10/2001 | Holder | 473/426 |
| 7,063,632 | B2 | * | 6/2006 | Green | 473/417 |
| 7,090,599 | B2 | * | 8/2006 | Hedgepath | 473/452 |
| 7,252,603 | B2 | * | 8/2007 | Bove et al. | 473/426 |
| 7,300,388 | B2 | * | 11/2007 | Sams, III | 482/89 |
| 7,494,432 | B2 | * | 2/2009 | Flanigan | 473/426 |
| 7,704,169 | B1 | * | 4/2010 | Bove et al. | 473/426 |
| 2005/0003908 | A1 | * | 1/2005 | Smull et al. | 473/419 |
| 2008/0102993 | A1 | | 5/2008 | Jackson | |

* cited by examiner

*Primary Examiner* — Mitra Aryanpour
(74) *Attorney, Agent, or Firm* — Thomas, Kayden, Horstemeyer & Risley, LLP

(57) ABSTRACT

Baseball practice systems are provided. In this regard, a representative baseball practice system includes: a backstop; a ball; a suspension assembly operative to suspend the ball in a strike zone, the suspension assembly having a first cantilevered arm and a damping assembly, the damping assembly being operative to damp motions of the ball as the ball returns to a rest position after having been struck, the cantilevered arm supporting a portion of the damping assembly; and a tether assembly comprising at least one line operative to assist in establishing the rest position of the ball.

19 Claims, 11 Drawing Sheets

(LEFTY-OUTSIDE)

(RIGHTY-INSIDE)

(LEFTY-INSIDE)

(RIGHTY-MIDDLE)
(LEFTY-MIDDLE)

(RIGHTY-OUTSIDE)

BASEBALL PRACTICE SYSTEMS

CROSS REFERENCE TO RELATED APPLICATION

This utility application claims priority to commonly owned U.S. Provisional Patent Applications Ser. No. 61/016,318, filed on Dec. 21, 2007, entitled "Batting Practice Device," and Ser. No. 61/138,219, filed on Dec. 17, 2008, entitled "Batting Practice Systems," both of which are incorporated by reference in their entireties.

BACKGROUND

1. Technical Field

The disclosure generally relates to baseball training aids.

2. Description of the Related Art

As in many other endeavors, practice is the activity which a ball player can most profitably utilize to improve his or her game. Thus, batting practice can be utilized to enable one to hit the ball more effectively; practice can also be counted on to improve a pitcher's control and delivery and a player's ability to field a ball.

Live practice is effective. However, it has the disadvantage that a number of players in addition to the one who is practicing are required. A batter, for example, must be supported by a pitcher, a catcher, and fielders. Consequently, for an entire team to take batting practice involves an investment in time and manpower which may make it impractical at best for a player to take extra practice or to practice when other players are not available. Live practice is also constrictive in that a playing field is required. This has resulted in a number of practice devices being proposed, including devices described in U.S. Pat. No. 5,795,250, entitled "Tethered Ball Practice Device," which is incorporated by reference herein in its entirety.

SUMMARY

Baseball practice systems are provided. In this regard, an exemplary embodiment of a baseball practice system comprises: a backstop; a ball; a suspension assembly operative to suspend the ball in a strike zone, the suspension assembly having a first cantilevered arm and a damping assembly, the damping assembly being operative to damp motions of the ball as the ball returns to a rest position after having been struck, the cantilevered arm supporting a portion of the damping assembly; and a tether assembly comprising at least one line operative to assist in establishing the rest position of the ball.

Another exemplary embodiment of a baseball practice system comprises flexible material having located thereon multiple indicia, a first of the indicia corresponding to home plate, a second of the indicia corresponding to a location at which a baseball is to be struck.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Baseball practice systems are provided, several exemplary embodiments of which will be described in detail. In some embodiments, such a system includes a tethered ball that is supported by one or more cantilevered arms. The ball is rapidly reset to a rest position after being struck by a bat. In some embodiments, positioning of the tethered ball can be coordinated with instructional markers that identify preferred impact locations for the ball and bat. These markers can be provided on a mat that also includes an indication of home plate.

Figure 1:
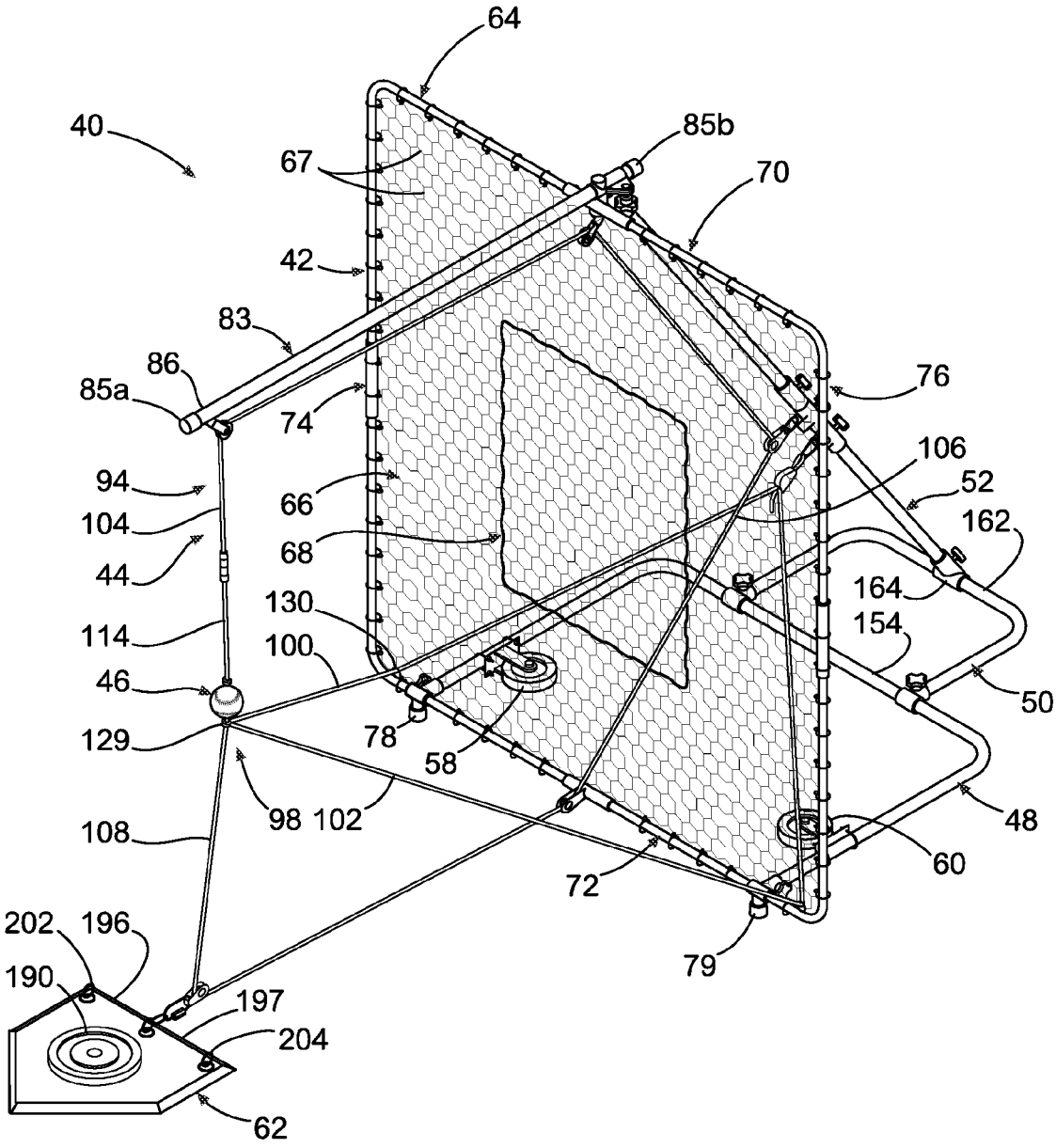
FIG. 1 is a perspective view of an embodiment of a practice system shown erected and configured for batting practice.

In this regard, FIG. 1 is a perspective view of an embodiment of a baseball practice system that incorporates a practice device erected and configured for batting practice. Notably, the practice device is identified by reference character 40 and is similar in many respects to a device disclosed in U.S. Pat. No. 5,795,250, entitled "Tethered Ball Practice Device."

The major components of the practice device of the embodiment of FIG. 1 are a backstop unit 42, a suspension system 44 for a ball 46, and U-shaped, surface-engaging components 48 and 50. Components 48 and 50 cooperate with a telescopic strut 52 to maintain backstop unit 42 in an erect position. Practice device 40 also has wheels 58 and 60 which can be lowered to roll the device from place-to-place and a home plate 62.

Backstop unit 42 includes a rectangular frame 64, a net 66, composed of filaments 67, and a cord 68 which can be threaded into net 66 at a location selected by a user to outline a strike zone. Backstop frame 64 has top and bottom rails 70 and 72 and side rails 74 and 76. Supporting feet 78 and 79 are fixed to bottom rail 72 at opposite ends of that rail. Backstop frame side rails 74 and 76 each have two sections (e.g., 76*a* and 76*b*) which are held in longitudinally aligned, end-to-end relationship when practice device 40 is set up for batting, fielding, or pitching practice. Bungee cord connector systems (not shown) keep the sections (e.g., 76*a*/76*b*) from becoming totally separated and making the backstop unit hard to handle. Net 66 is open mesh construction. Its filaments 67 are fabricated of resilient material so that balls striking the net will bounce back toward one using practice device 40.

The ball-suspension system 44 utilized when device 40 is configured for batting practice includes an elongated, cantilevered arm 83 extending at normally from and supported at one end from the top rail 70 of backstop frame 64 in the fitting 84. This fitting allows the opposite, free end 86 of the arm to be swung horizontally as indicated by arrow 90 in FIG. 4. As a consequence, ball 46 can be moved from side-to-side of a movable base (home plate) 62 as shown in the same figure. Thus, ball 46 can be readily positioned to emulate inside and outside pitches and pitches which cross the center of home plate 62. Also, fitting 84 allows arm 83 to be swung to an out-of-the-way position for storage and transportation of practice device 40.

Figure 2:
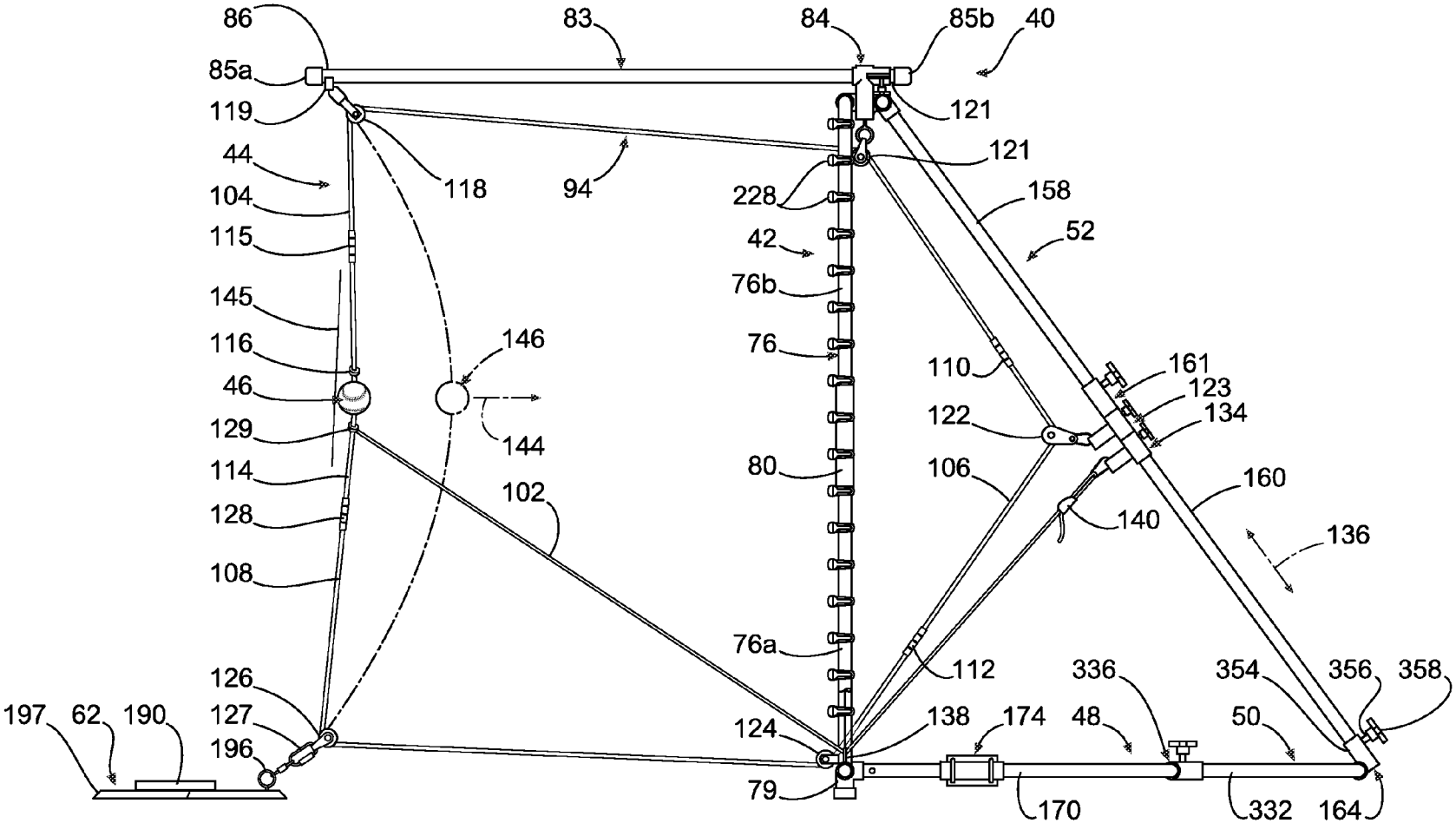
FIG. 2 is a side view of the embodiment of FIG. 1.
Figure 3:
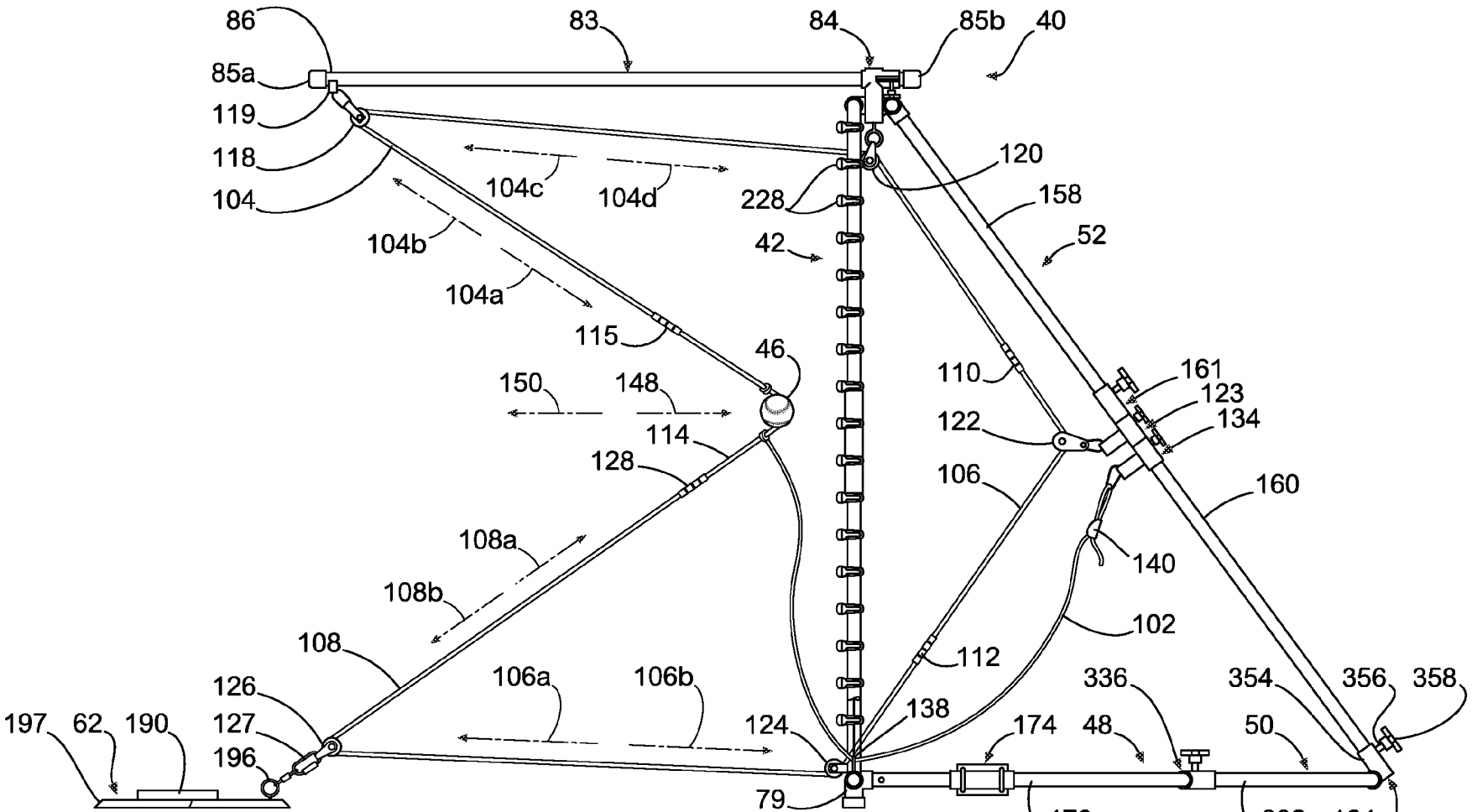
FIG. 3 is a view similar to FIG. 2 but with a game ball component displaced.

Ball-suspension system (suspension assembly) 44 also includes an elastic damping unit 94 (damping assembly) and a tether assembly 98 composed of two inextensible cords 100 and 102. Damping unit 94 of suspension system 44 is composed of three bungee cords 104, 106, and 108 joined in end-to-end relationship by connectors or couplings 110 and 112. An elastic cord 114 is strung through ball 46 and immobilized along the cord between two knots, one above and one below the ball. The upper knot is shown in FIGS. 1-3 and identified by reference character 116.

One end of bungee cord 104 is fixed to the upper end of cord 114 by connector 115. From there, the bungee cord is trained through a pulley 118 suspended from cantilevered arm 83 near the free end 86 of that component by an eye bolt 119 and through a second pulley 120 suspended from arm 83 at the opposite, frame-associated end 121 of the arm. The second bungee cord 106 extends from connector 110 through a pulley 122 suspended from telescopic, backstop unit supporting strut 52 intermediate the upper and lower ends of that component. Pulley 122 is attached to a fitting 123 which is mounted on and slidable along telescopable strut 52. The third bungee cord 108 extends from connector 112 through: (1) a pulley 124 suspended from the bottom rail 72 of backstop frame 64, and (2) a pulley 126 suspended from home plate 62 by a quick release fitting 127 to (3) a connector 128 which couples bungee cord 108 to the lower end of ball-supporting cord 114. Notably, in other embodiments, various other forms of anchoring of cord 108 can be used. By way of example, a movable plug can be used to anchor the cord to a corresponding hole in the plate. Additionally or alternatively, the plate can be weighted down, such as by filling the plate (which may include an interior cavity) with sand or water, for instance. In still other embodiments, anchoring of cord 108 can be provided by a component that does not take on the shape of home plate.

Figure 4:
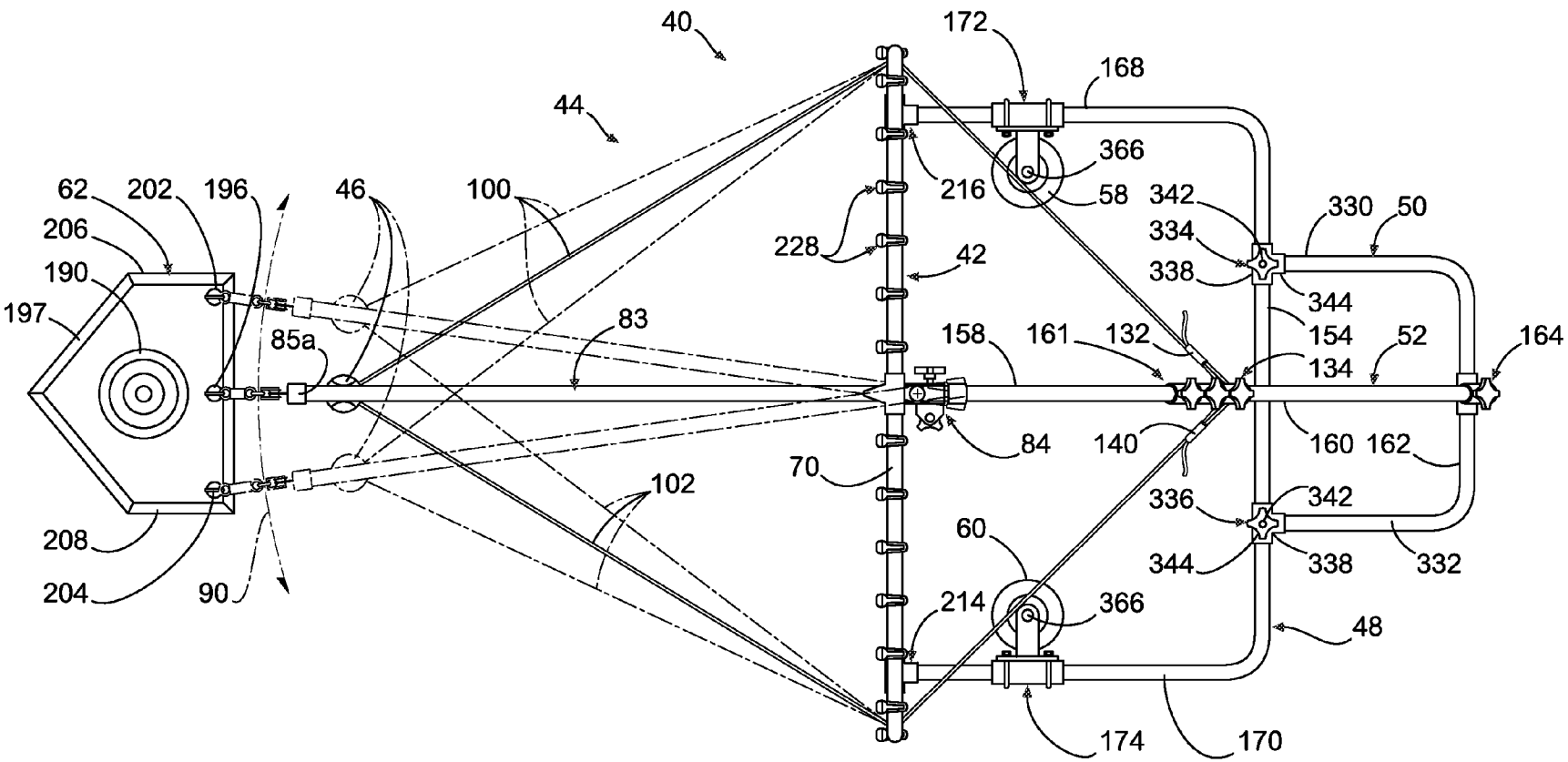
FIG. 4 is a top view of the embodiment of FIG. 1 showing a cantilever-mounted arm pivoted to move the ball.

As is best shown in FIG. 4, the two cords 100 and 102 of tether 98 are tied at one end, and at the same location 129 beneath ball 46, to the ball-supporting cord 114. From there, tether component 100 is trained through the eye of an eye bolt 130 at the lower end of backstop frame side rail 74 and then through a ratchet-type keeper or latch 132. Latch 132 is best shown in FIG. 4 and is suspended from telescopic strut 52 toward the lower end of that component by a fitting 134 which is adjustable along the strut as indicated by arrow 136 in FIG. 2. The second of the tether cords 102 similarly extends from the location 129 where it is tied to cord 114 beneath ball 46 through the eye of an eye bolt 138 at the opposite side of backstop frame 64 and toward the lower end of side rail 76 and then through a second ratchet-type latch 140 also suspended from fitting 134.

Fitting 123 is adjusted along strut 52 to raise and lower ball 46, thus emulating high and low pitches. Displaceable fitting 134 can at the same time be moved along strut 52 as necessary to accommodate the ball height-adjusting displacement of fitting 123.

Tether components 100 and 102 are tightened to slightly tension the cords of damping system 94 by pulling equally on ball 46 to displace it in the arrow 144 direction (see FIG. 2.) from a straight line 145 extending between bungee cord-supporting pulleys 118 and 126. The represented displacement of ball 46 in FIG. 1 closely approximates the displacement actually-employed in setting up practice device 40 for batting practice. Greater displacement, for example to the position identified by reference character 146 in FIG. 2 with the consequent, illustrated bowing of bungee cords 104 and 108 and ball-supporting line 114 would place too much tension on the bungee cord; and the practice device would not function properly; i.e., it would not rapidly damp movements of ball 46 as the ball returns to its rest position after being struck.

Turning now to FIG. 3, the impact of a bat drives ball 46 toward backstop unit 42 as suggested by arrow 148. This stretches and displaces the elastic bungee cords 104, 106, and 108 of damping system 94 as shown by arrows 104*a*, 104*c*, 106*a*, and 108*a*, storing potential energy in those segments; and the cords 100 and 102 of tether 98 becomes slack. Next, as the ball reaches the end of its movement toward net 66, the stored potential energy is converted to kinetic energy which returns ball 46 to the rest position shown in FIGS. 1 and 2 as indicated by arrow 150 in FIG. 3. Damping system bungee cords 104, 106, and 108 contract to their original lengths and return to their at rest positions with the motions of the cords being indicated by arrows 104*b*, 104*d*, 106*b*, and 108*b* as this occurs.

As ball 46 reaches the rest position, tether lines 100 and 102 become taut and keep ball 46 from traveling in the arrow 150 direction beyond that position. With the tether tied to ball-supporting cord 114 beneath ball 46 and with damping system 94 tensioned to the extent just described, system 94 efficiently damps the oscillations of ball 46 as its supporting line 114 is brought to an abrupt halt by tether 98. As a consequence, ball 46 is almost immediately restored to and made motionless in the rest position after being struck.

When practice device 40 is configured and rigged for batting practice, backstop unit 42 is positioned in an upright or vertical orientation as shown in FIGS. 1-3. For pitching and fielding practice, the backstop unit may be tilted forwardly by strut 52 (typically through a maximum arc of 20 degrees) so that a ball striking backstop net 66 will be returned as a ground ball. Conversely, the backstop unit may be tilted backwardly (typically through a maximum angle of 45 degrees) so that a ball striking net 66 will rebound from the net in the air.

Home plate 62 is of conventional shape and dimensions. The home plate can be anchored to the playing surface by placing a weight 190 on the plate (see FIGS. 1 and 4). If the surface is smooth—for example, a gymnasium floor—suction cups 191 attached to the bottom 192 of the home plate can instead be used to anchor the home plate to supporting surface 152. Also, home plate 62 can be anchored by driving a spike 194 into the ground. The spike is connected to an eye bolt 196 at the rear edge 197 of home plate 62 by a tether 198.

The eye bolt 196 is located both toward the rear edge 197 of home plate 62 and in the center of that practice device component. Two other eye bolts, identified by reference characters 202 and 204, are also located toward the rear edge 197 of home plate 62 but at opposite sides 206 and 208 of the home plate. By coupling damping system fitting 127 to eye bolt 202, ball 46 can be positioned as shown in FIG. 4 to emulate a pitch which is on the inside of the plate to a left-handed hitter.

Similarly, by connecting the fitting to the eye bolt 204 at the opposite side 208 of home plate 62, ball 46 can be positioned to emulate a ball which is on the outside of the plate to the left-handed batter.

Various configurations and/or components can be used in other embodiments in contrast to the ones described above. By way of example, although various cords/lines are described as being elastic in the embodiment of FIGS. 1-4, other embodiments could use one or more inelastic cords. Notably, additional information on other exemplary embodiments can be found in U.S. Provisional Patent Application Ser. No. 61/138,219, filed on Dec. 17, 2008, entitled "Batting Practice Systems," which is incorporated by reference herein.

Other embodiments of baseball practice systems are depicted in FIGS. 5-12. Each of these embodiments includes an optional second cantilevered arm. In these embodiments, the arms are vertically spaced from each other to support the ball so that the ball is suspended between the arms. Notably, the second (bottom) arm prevents misalignment of the lines (and/or associated pulleys), thereby potentially increasing the effective life of the lines.

Figure 5:
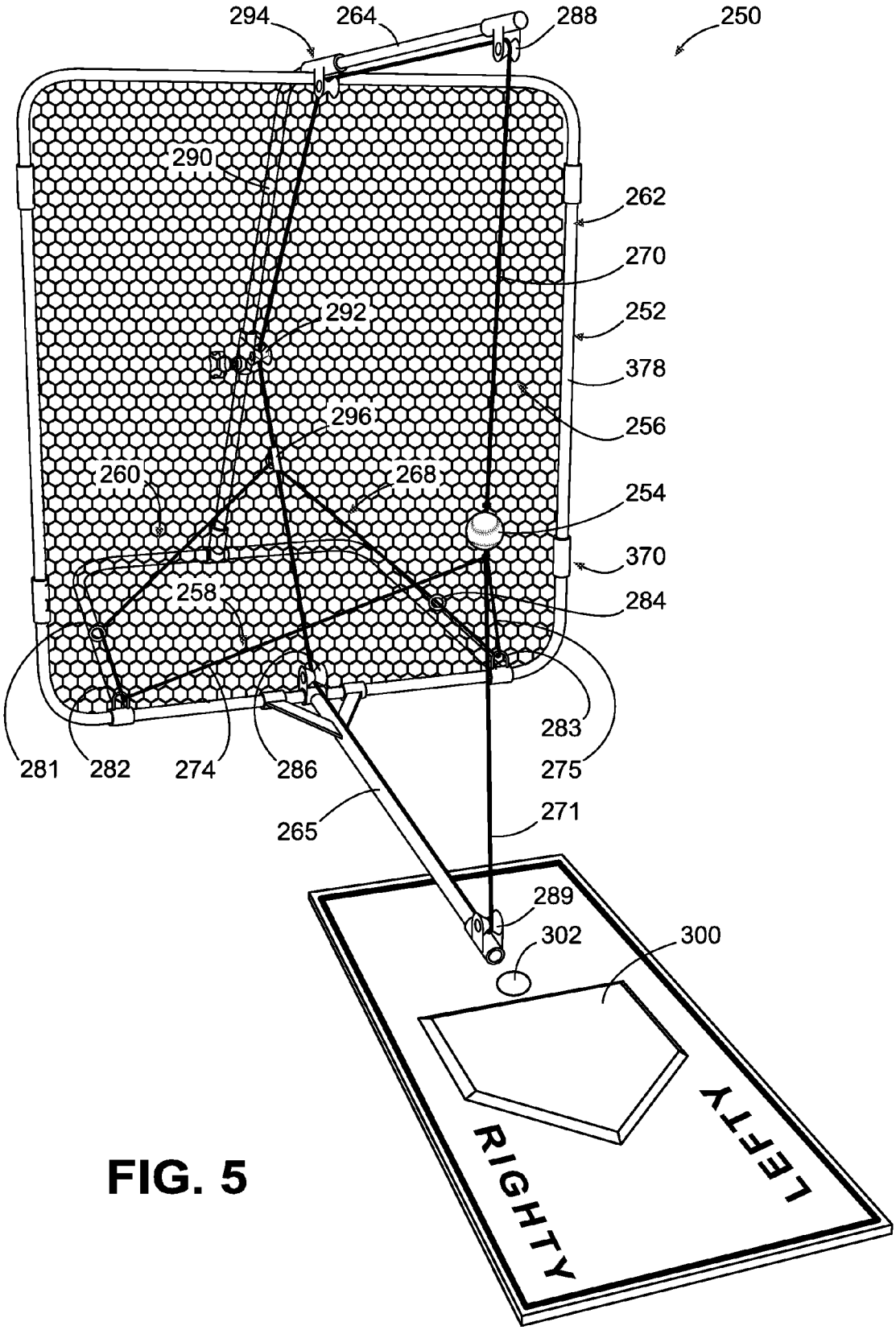
FIG. 5 is a perspective view of another embodiment of a practice system.

As shown in FIG. 5, baseball practice system 250 includes a backstop 252, a ball 254, a suspension assembly 256 and a tether assembly 258. Backstop 252 incorporates a base 260 and frame 262, which is used to support a net (not shown in FIG. 5), that can add pitch-back functionality. Suspension assembly 256 incorporates upper and lower arms 264, 265 and a damping assembly 268. The arms suspend the ball in a strike zone, and the damping assembly damps motions of the ball as the ball returns to a rest position (depicted in FIG. 5) after being struck. In this embodiment, the damping assembly includes bungee cords 270, 271. Tether assembly 258 incorporates lines 274, 275 that assist in establishing the rest position of the ball.

In the embodiment of FIG. 5, pulleys and eyelets are used to route the various lines and cords. Specifically, base 260 includes eyelets 281, 282, 283 and 284, as well as pulley 286 (shown in greater detail in FIG. 6). Arms 264, 265 mount pulleys 288 and 289, respectively. Additionally, telescopable strut 290 includes eyelet 292, as well as a cord pass-through 294. As such, cord 270 passes from a connector 296, through eyelet 292, though pass-through 294, then pulley 288 to ball 254. Cord 271 passes from connector 296, through pulleys 286 and 289 to ball 254. Line 274 passes from connector 296, through eyelets 281 and 282 to ball 254, and line 275 passes from connector 296, through eyelets 284 and 283 to ball 254.

In FIG. 5, an optional marker 300 (e.g., representative of home plate) and another optional marker 302 (representative of a location at which ball 254 is to be struck relative to home plate) are depicted. These markers can be moved relative to the backstop so that different types of pitches can be simulated. Use of markers will be described in greater detail later.

Figure 6:
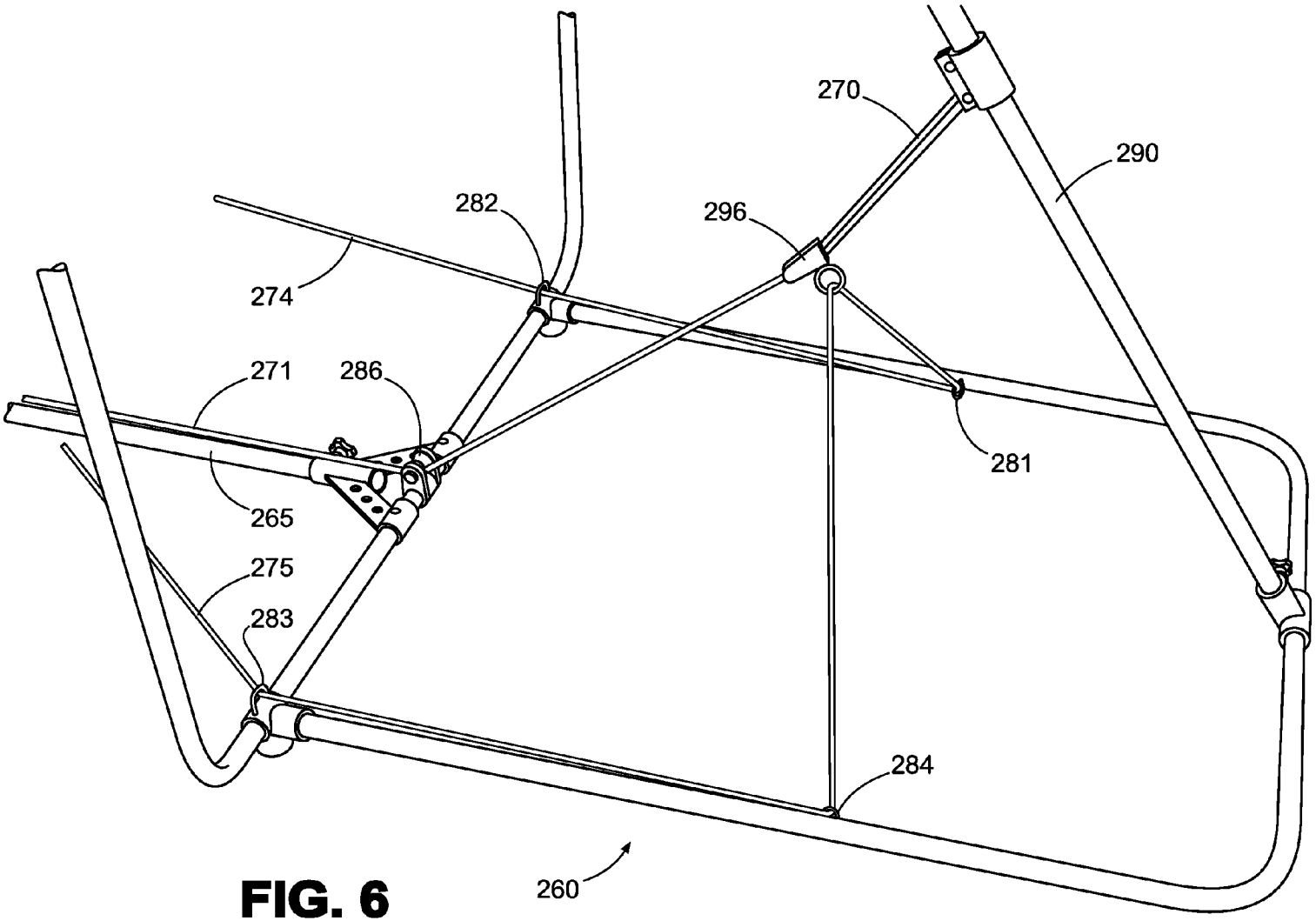
FIG. 6 is a partial view of the embodiment of FIG. 5.
Figure 7:
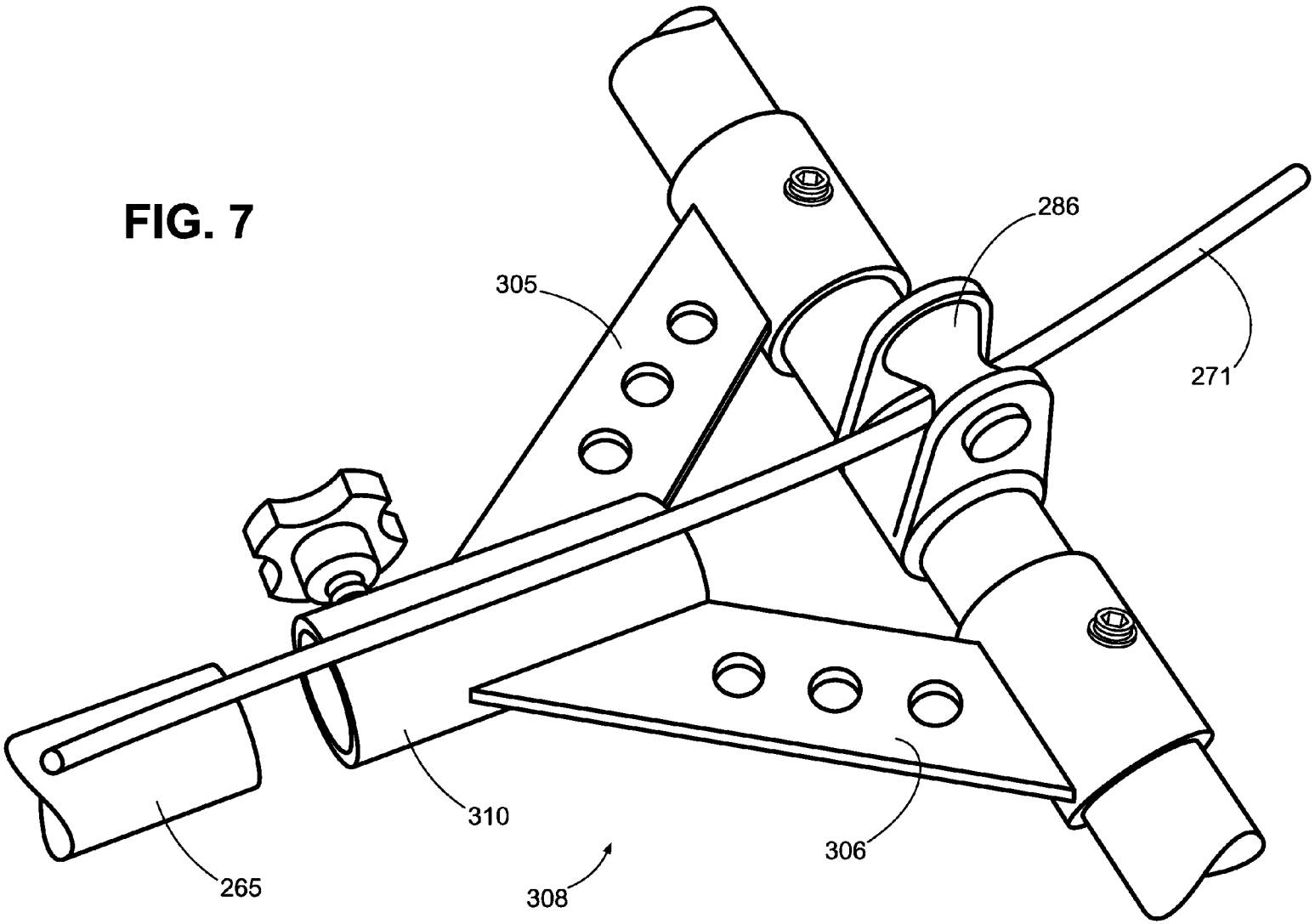
FIG. 7 is a partial view of the embodiment of FIGS. 5 and 6.

FIG. 7 is a partial view of the embodiment of FIGS. 5 and 6. As shown in FIG. 7, pulley 286 is located between supports 305, 306 of mount 308. Mount 308 includes a receptacle 310 that receives the proximal end 312 of arm 265.

Figure 8:
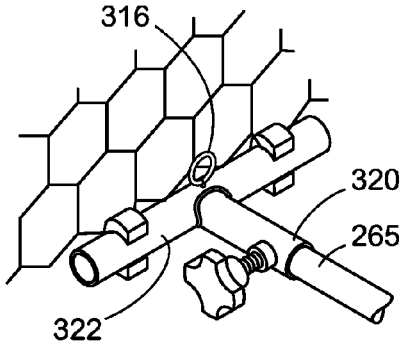
FIG. 8 is a partial view depicting an alternative configuration for attaching a cantilevered arm.

FIG. 8 is a partial view depicting an alternative configuration. Notably, instead of using a pulley 286, an eyelet 316 (provided in this embodiment by an eyebolt) is used for routing cord 271 (not shown in FIG. 8). Additionally, a receptacle 320 is connected directly to frame member 322 for attaching arm 265.

Figure 9:
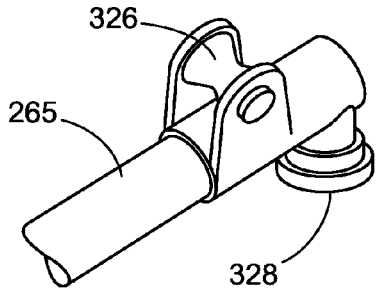
FIG. 9 is a partial view of the embodiment of FIGS. 5-7, showing detail of a pulley.

FIG. 9 is a partial view of the embodiment of FIGS. 5-7, showing detail of pulley 289. Notably, pulley 289 includes a pulley component 326 and a lower base 328 that is used to engage a load bearing surface (e.g., the ground).

Figure 10:
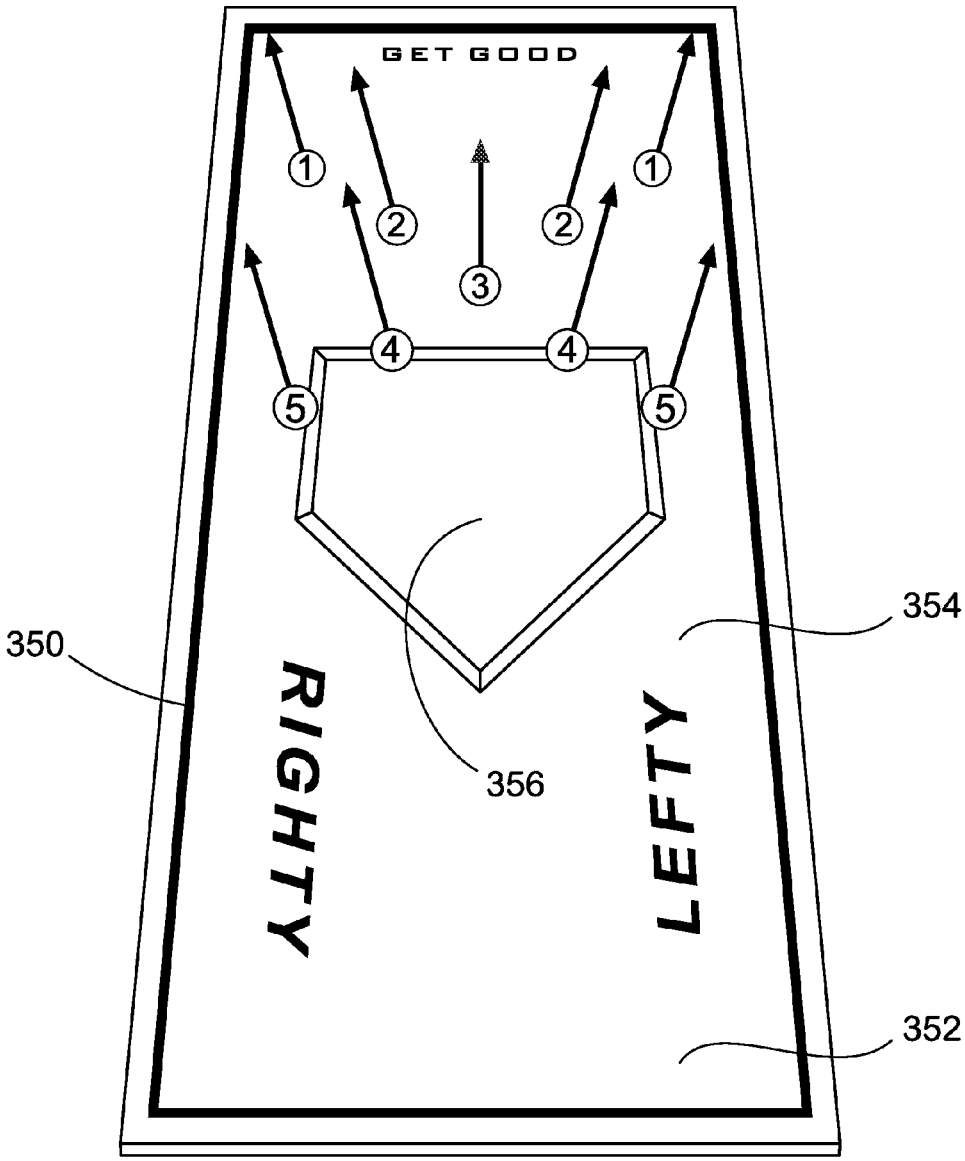
FIG. 10 is a perspective view of another embodiment of a practice system.
Figure 11B:
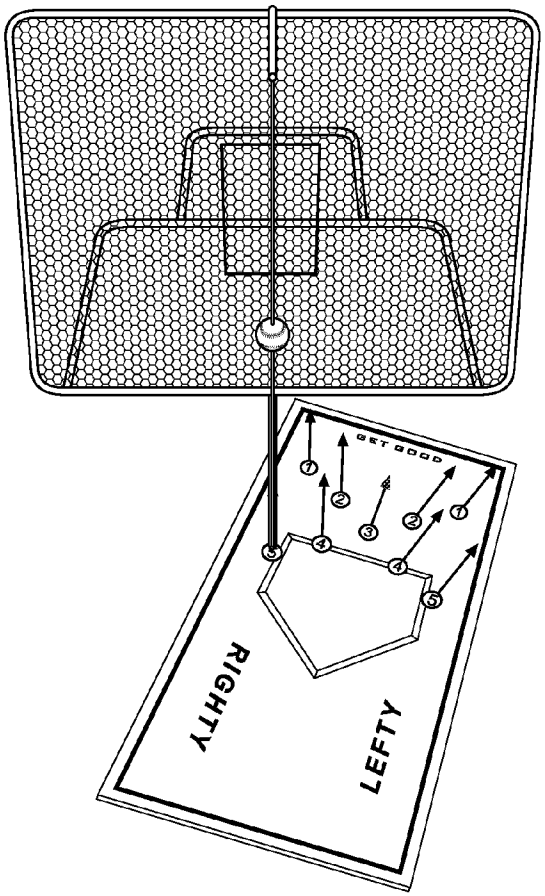
FIGS. 11A-11E depict an embodiment of a practice system with relative positions of a suspended ball and a hitting mat being changed to simulate different types of pitches.
Figure 11A:
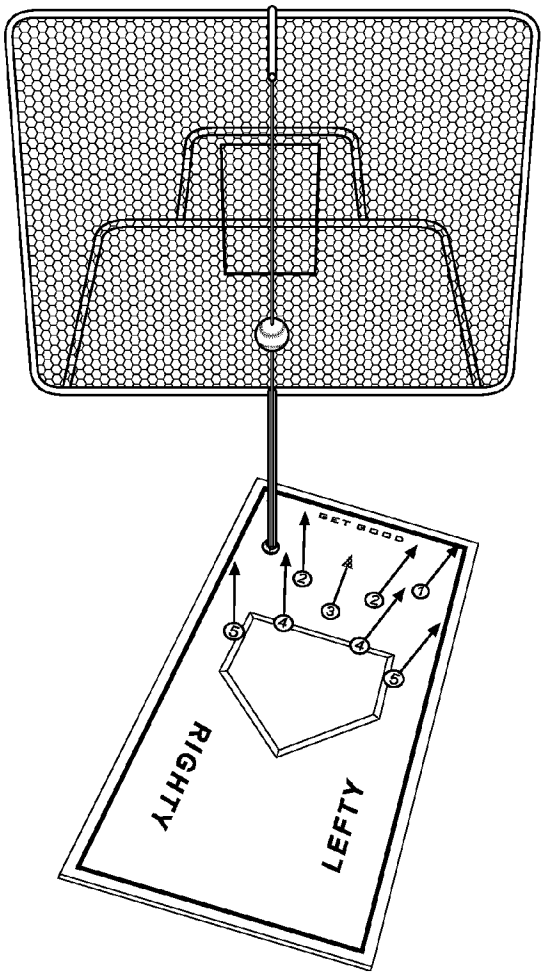
Figure 11D:
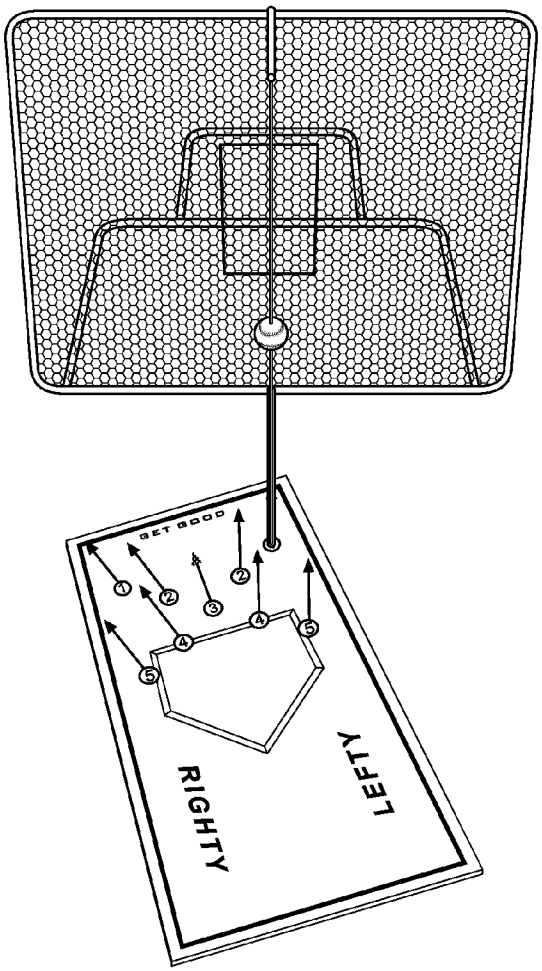
Figure 11C:
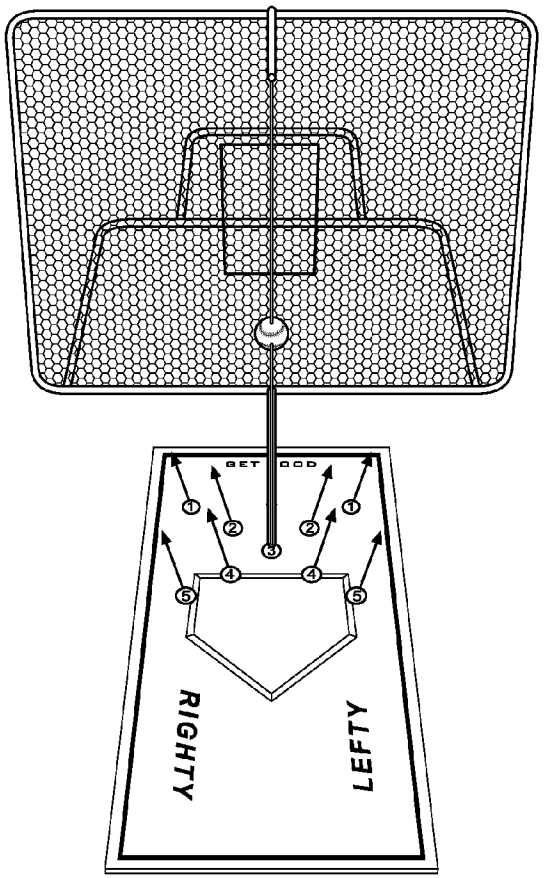

FIG. 10 is a perspective view of another embodiment of a practice system. In this embodiment, the principal component is a set 350 of markers that replicate the inner portion of a baseball batter's box. As shown in FIG. 10, the markers are provided by a top surface 352 of a flexible mat 354 that can be formed of various materials (e.g., those materials used for yoga mats). A marker 356 corresponds to an official size home plate. Mat 354 is marked for both right and left handed hitters and includes additional markers (e.g., numbered baseballs) that show proper contact points plus directional arrows to show where to drive the pitches. In other embodiments, markers for only a right handed or a left handed batter can be provided.

In the embodiment of FIG. 10, nine markers are used to form an X-pattern. This pattern is a visualization of where a hitter should contact the ball as it comes across home plate. The arrows coming off the balls indicate the desired direction of flight of the ball. The 1 ball is for inside pitches, the 2 ball is for slightly inside pitches, the 3 ball is down the middle, the 4 ball is for slightly outside pitches and the 5 ball is for outside pitches. FIGS. 11A-11E depict relative positions of a suspended ball relative to the markers of FIG. 10 for different types of pitches.

Figure 12:
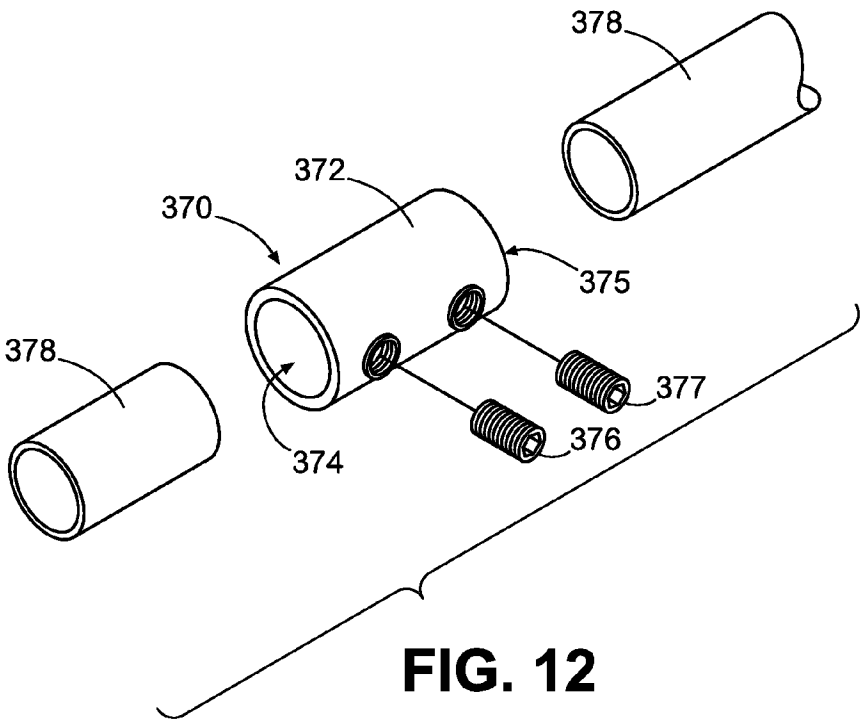
FIG. 12 is a partially cutaway, assembly view of a coupler and corresponding frame members.
Figure 11E:
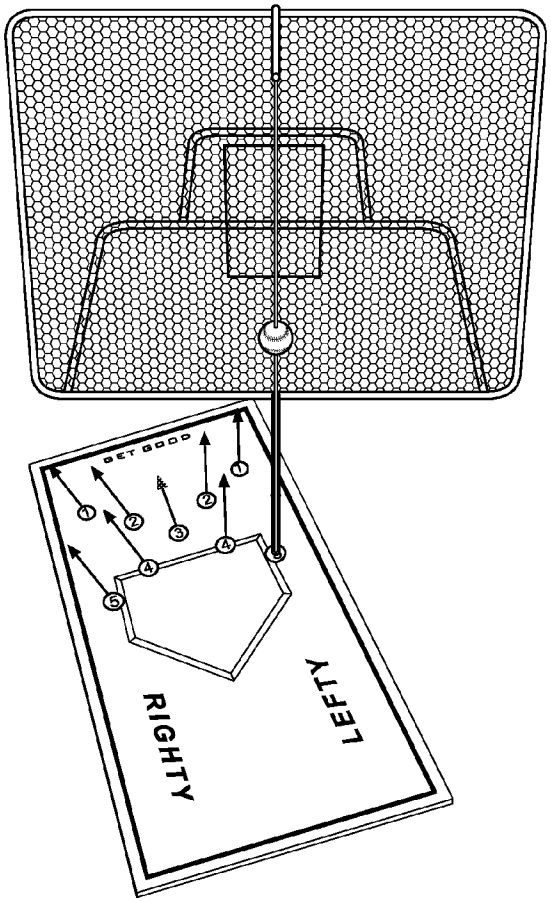

FIG. 12 is a partially cutaway, assembly view of a coupler and corresponding frame members. Notably, various backstop configurations can be used. In some embodiments, a backstop can be formed of multiple frame members that are attached to each other either directly or indirectly, such as by using couplers. In FIG. 12, an exemplary embodiment of a coupler is depicted.

As shown in FIG. 12, coupler 370 includes a body 372 with opposing receptacles 374, 375. A set screw (376, 377) communicates with each of the receptacles to capture a distal end of a corresponding frame member (member 378) within each of the receptacles. Notably, use of a coupler can facilitate ease of assembly and can reduce shipping costs since the frame can be broken down into relatively small portions for packaging and shipping.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. All such modifications and variations are intended to be included herein within the scope of this disclosure and protected by the accompanying claims.

The invention claimed is:

1. A baseball practice system comprising:

a backstop;

a ball;

a suspension assembly operative to suspend the ball in a strike zone located forward of the backstop, the suspension assembly having a first cantilevered arm, a second cantilevered arm and a damping assembly;

the ball being suspended in the strike zone by the damping assembly between the first cantilevered arm and the second cantilevered arm, the damping assembly comprising at least one cord and being operative to damp motions of the ball as the ball returns to a rest position after having been struck, the damping assembly extending from a position forward of the backstop, along the first and second cantilevered arms and to a position behind the backstop; and a tether assembly comprising at least one line and being operative to assist in establishing the rest position of the ball, the tether assembly being attached to the damping assembly at a first location adjacent to the ball and a second location behind the backstop.

2. The system of claim 1, wherein the second cantilevered arm is fixed in position with respect to the backstop.

3. The system of claim 1, wherein the at least one line of the tether assembly is an elastic line.

4. The system of claim 1, further comprising a marker corresponding to a location at which the ball is to be struck, the marker being movable with respect to the ball.

5. The system of claim 4, wherein the marker corresponds to home plate.

6. The system of claim 4, wherein:

the system further comprises a hitting mat having a top surface; and the marker is displayed on the top surface of the hitting mat.

7. The system of claim 6, wherein the marker is one of multiple markers on the hitting mat, each of which corresponds to a different location at which a ball is to be struck.

8. The system of claim 6, wherein the hitting mat is operatively detached from the backstop and suspension assembly.

9. The system of claim 1, wherein the backstop comprises frame members interconnected with couplers, each of the couplers having opposing openings operative to receive an end of a corresponding frame member and set screws operative to set the corresponding ends within the openings of the couplers.

10. The system of claim 1, wherein:

the damping assembly comprises lines; and the backstop comprises eyelets operative to position the lines of the damping assembly.

11. The system of claim 1, further comprising a telescopeably extensible strut pivotally fixed to and extending downwardly from an upper frame member of the backstop, the strut being operative to maintain the backstop at a user-selected angle relative to a load bearing surface.

12. The system of claim 1, wherein the suspension assembly is adjustable to raise and lower the ball relative to a load bearing surface upon which the system is supported.

13. The system of claim 1, further comprising a movable base representative of home plate.

14. The system of claim 13, wherein a line of the damper assembly is operative to attach to the movable base.

15. The system of claim 8 wherein the hitting mat comprises flexible material having located thereon multiple indicia, a first of the indicia corresponding to home plate, a second of the indicia corresponding to a location at which a baseball is to be struck.

16. The system of claim 15, wherein the multiple indicia form an X-pattern, with a center of the X-pattern being located outside of a perimeter defining the home plate.

17. The system of claim 1, wherein:

the at least one line of the tether assembly is an inextensible line; and the at least one cord of the damping assembly is an extensible cord.

18. The system of claim 1, wherein the tether assembly is routed through fixed and laterally spaced third and fourth locations, each of which is positioned intermediate the first location and the second location, such that the tether assembly is operative to assist in establishing a lateral component of the rest position of the ball.

19. A baseball practice system comprising:

a hitting mat of flexible material having located thereon multiple indicia, a first of the indicia corresponding to home plate, a second of the indicia corresponding to a location at which a baseball is to be struck;

a backstop;

a ball;

a suspension assembly operative to suspend the ball in a strike zone located above the home plate and forward of the backstop, the suspension assembly having a first cantilevered arm and a damping assembly, the damping assembly being operative to damp motions of the ball as the ball returns to a rest position after having been struck, the cantilevered arm supporting a portion of the damping assembly, the damping assembly extending from a position forward of the backstop, along the cantilevered arm and to a position behind the backstop;

a second cantilevered arm, the ball being suspended between the first cantilevered arm and the second cantilevered arm; and a tether assembly comprising at least one line operative to assist in establishing the rest position of the ball, the tether assembly being attached to the damping assembly at a first location adjacent to the ball and a second location behind the backstop such that the tether assembly is operative to assist in establishing lateral component of the rest position of the ball.

* * * * *